United States Patent [19]

Finger, Jr.

[11] Patent Number: 4,779,568

[45] Date of Patent: Oct. 25, 1988

[54] COMBINED PERSONAL IDENTIFICATION, SAFETY, AND CONVENIENCE DEVICE

[76] Inventor: James S. Finger, Jr., Country House Rd., Millbrook, N.Y. 12545

[21] Appl. No.: 939,365

[22] Filed: Dec. 8, 1986

[51] Int. Cl.[4] ..... G10K 5/00; A45C 11/00

[52] U.S. Cl. ..... 116/137 R; 116/2; 116/DIG. 44; 206/0.81; 206/37

[58] Field of Search ..... 116/2, 3, 137 R, DIG. 44; 206/0.80, 0.81, 0.82, 37, 38; 40/323, 27.5

[56] References Cited

U.S. PATENT DOCUMENTS

| | | | |
|---|---|---|---|
| 944,744 | 12/1909 | Pine | 40/323 |
| 1,116,660 | 11/1914 | Willis | 206/0.81 |
| 2,013,027 | 9/1935 | Branch | 206/38 |
| 2,185,359 | 1/1940 | Swanson | 206/0.81 |
| 2,511,651 | 6/1950 | Schlitz | 40/323 |
| 2,892,537 | 6/1959 | Schwartz | 206/0.81 |
| 3,141,546 | 7/1964 | Leopoldi | 206/0.81 |
| 3,286,751 | 11/1966 | Dishart | 206/0.81 |
| 3,473,648 | 10/1969 | Pallizzi | 206/0.81 |
| 4,327,512 | 5/1982 | Oliver | 206/0.81 |
| 4,449,474 | 5/1984 | Mariol | 116/137 R |

*Primary Examiner*—William A. Cuchlinski, Jr.
*Assistant Examiner*—Thomas B. Will

[57] ABSTRACT

A combined personal identification, sound producer, and repository device is of oblong hollow construction, including two chambers, one of which is formed as a whistle, and the other is provided with access through the body of the device for retaining coins or the like. The opening into the second chamber includes a door which can be selectively opened or latched closed.

1 Claim, 1 Drawing Sheet

COMBINED PERSONAL IDENTIFICATION, SAFETY, AND CONVENIENCE DEVICE

BACKGROUND OF THE INVENTION

The field of this invention is personal identification and safety, and more particularly the invention relates to a unitary structure that can be carried or worn on a person which provides for identification, includes a mechanism for making audible sounds, and includes a repository for small articles.

Everyone is faced with the possibility of coming under personal attack, becoming unconscious for many reasons, and even becoming separated from a group of people. There is increasing concern about children and their safety. Depending on their age, it becomes important to provide an identification for the child which indicates the child's name, address, and parents name. Also, when away from home the child may become separated from a group and have the need for signaling to the group where the child is located. Some children do not carry money, so it is also desirable to provide a device whereby the child can be provided with sufficient money to utilize a pay phone if that is available.

In view of the above remarks, it is clear that for any individual, and in particular a child, it is desirable to provide a device which can in combination provide for the identification of the child, provide a means for creating sound either for alerting or locating, and include a repository for money to make necessary phone calls.

SUMMARY OF INVENTION

It is the primary object of this invention to provide a device that can be worn or carried on the person which provides for identification, the creation of sound, and a repository for small articles such as coins.

This object is accomplished by the present invention which includes a plastic, oblong hollow body which can be carried or worn on the person. One end of the body is formed into a chamber and provided with well known construction which creates a whistle. A second hollow chamber is created in the body and includes an opening, with cover, which can be selectively latched closed or opened to provide access to the second chamber which can include coins for using pay telephones. The outer surface of the device also can include engraving to provide identification including name, address, phone number, and the name of parents in the case of a child.

DETAILED DESCRIPTION OF THE PREFERRED EMBODIMENT

Figure 1:
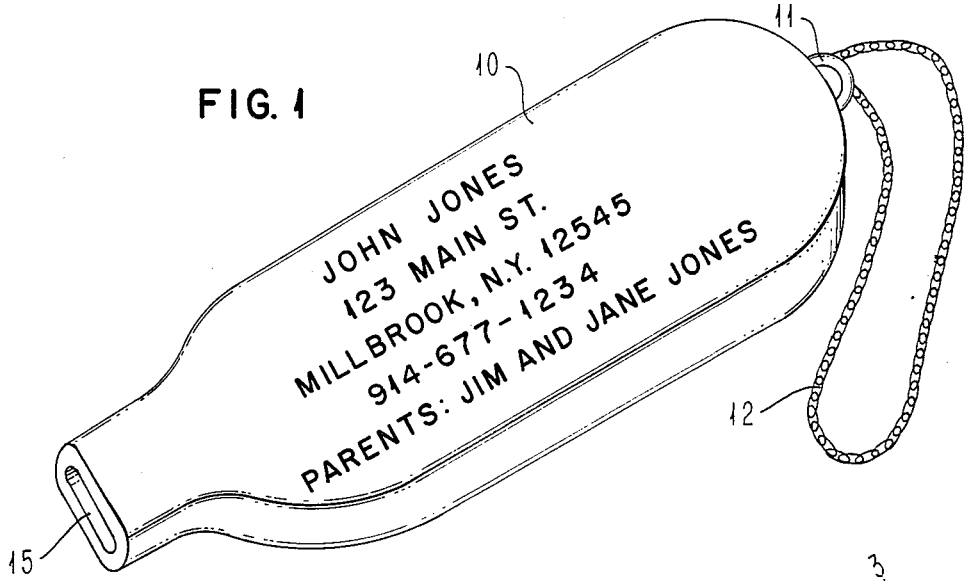
FIG. 1 is a perspective view of a first side of the subject invention.
Figure 2:
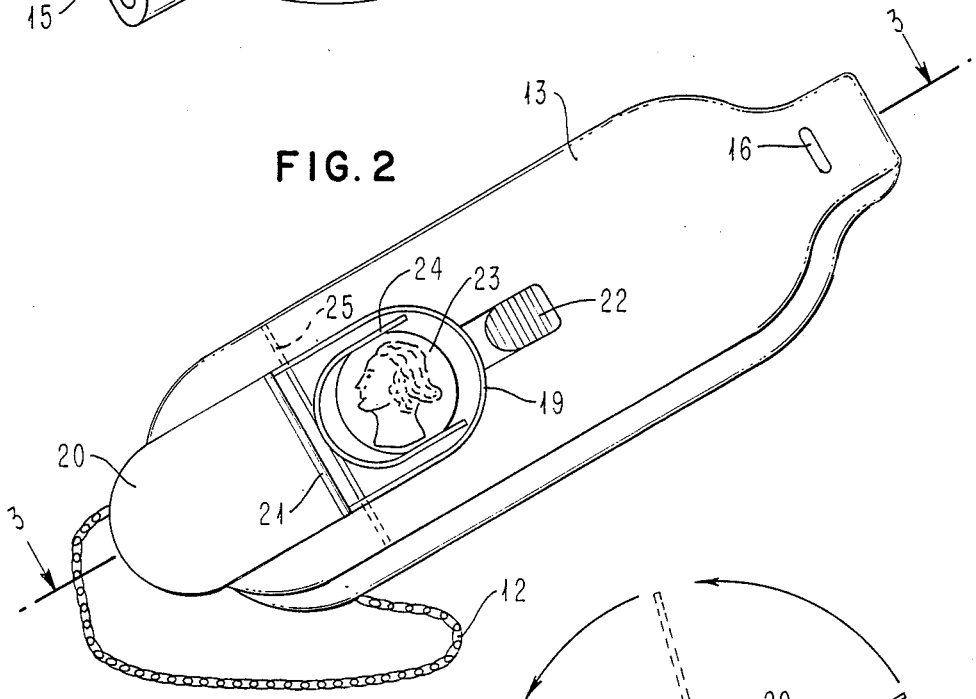
FIG. 2 is a perspective view of a second side of the present invention showing a means for access to the interior of the device.

FIG. 1 and FIG. 2 together show a first and a second side respectively of the present invention. The first side 10 of the oblong body provides a surface for identification of the person carrying the device. The construction of the device includes a loop 11 for accommodating a chain 12 allowing the device to be worn around the neck of the person.

FIG. 2 shows a second side 13 of the device. With reference to the cross section shown in FIG. 3, there is disclosed at one end of the oblong, hollow device, a chamber 14. Openings 15 and 16, and a ball 17, associated with chamber 14, create a whistle.

Figure 3:
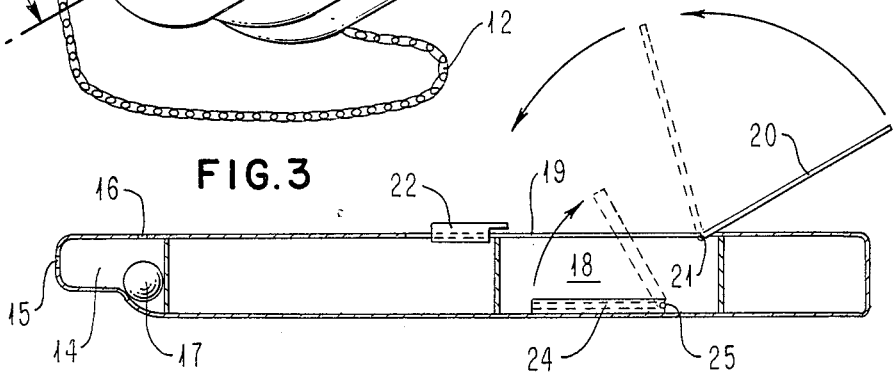
FIG. 3 is a cross section of the present invention showing interior chambers including one chamber comprising a whistle.

As shown in FIG. 3, a second chamber 18 is formed in the hollow, oblong body. An opening 19 in the surface of side 13 provides access to the chamber 18. A door 20 pivoted at 21 in the body provides for selectively closing or opening access to the chamber 18 through the opening 19. A latch mechanism 22 is slidable in the surface of side 13 to latch the door 20 closed.

One final feature of the invention is to provide a repository for coins to be used with pay telephones. As shown in FIG. 2 and FIG. 3, coins 23 can be retained in a U-shaped slotted retainer 24. The retainer 24 can be pivoted at 25 to provide easy access to the coins through the opening 19 when the door 2 is opened.

As one final feature of the invention, the chain 12 can be made adjustable so that the device can be hidden when worn around the neck, and the chain can be constructed to allow for easy separation to prevent the possibility of choking the wearer. Further, the color of the device can be red or emergency orange for easy visibility.

There has thus been shown in the preferred embodiment, a combined personal identification, signaling, and repository device which serves many purposes for a child in particular. If subjected to attack, the bearer of the device can sound a whistle to draw attention to the situation. If a child gets separated from a group, in the woods for example, use of the whistle will allow others to determine the childs location. Any user of the device who might become unconscious, can be identified by the markings on the device. Older children who know how to use pay telephones, are provided with a repository for coins to be used with a pay telephone.

What is claimed is:

1. An item for wear or transport on a person comprising:

an elongated hollow body including a first external surface accommodating a visible identification of the person;

a first chamber in one end of said hollow body comprising a whistle;

a second chamber in said hollow body;

an opening in said body providing access to said second chamber, said second chamber including pivoted coin holding means providing access to coins through said opening; and a cover for said openings, including means for providing a selectable open or closed position, whereby said whistle can provide audible sounds and said chamber can enclose items for use by the person.

* * * * *